US005190212A

United States Patent [19]

Morris

[11] Patent Number: 5,190,212

[45] Date of Patent: Mar. 2, 1993

[54] COLLAPSIBLE DIVIDER FOR A SHIPPING BOX

[75] Inventor: Jerry F. Morris, Harrisonburg, Va.

[73] Assignee: Packaging Services Inc., Weyers Cave, Va.

[21] Appl. No.: 855,714

[22] Filed: Mar. 20, 1992

[51] Int. Cl.[5] ..... B65D 5/48

[52] U.S. Cl. ..... 229/120.29; 229/120.26; 229/120.36; 229/120.38

[58] Field of Search ..... 229/120.26, 120.29, 229/120.31, 120.36, 120.38, 120.24, 120.27, 120.28; 217/30–33

[56] References Cited

U.S. PATENT DOCUMENTS

| | | | |
|---|---|---|---|
| 1,636,508 | 7/1927 | Goodyear | 229/120.28 |
| 1,978,719 | 10/1934 | Parnin | 217/32 |
| 2,673,656 | 3/1954 | Cunningham | 217/32 |
| 2,778,522 | 1/1957 | Berke | 217/33 |
| 3,009,625 | 1/1959 | Ackley et al. . | |
| 3,199,759 | 8/1965 | Hickin | 229/120.26 |
| 3,770,184 | 11/1973 | Rockefeller | 229/120.26 |
| 3,840,171 | 10/1974 | Waters | 229/120.24 |
| 3,985,286 | 10/1976 | Hicks | 229/120.26 |
| 4,071,185 | 1/1978 | Peters, Jr. . | |
| 4,108,349 | 8/1978 | Pfaffendorf | 229/120.26 |
| 4,164,312 | 8/1979 | Harned . | |
| 4,335,842 | 6/1982 | Bradford et al. . | |
| 4,351,471 | 9/1982 | Dunkle . | |
| 4,376,507 | 3/1983 | Nauheimer . | |
| 4,376,508 | 3/1983 | Gardner et al. . | |
| 4,379,518 | 4/1983 | Taylor, Sr. . | |
| 4,492,332 | 1/1985 | Collins . | |
| 4,754,916 | 7/1988 | Knight, Jr. . | |
| 4,756,469 | 7/1988 | Hansen . | |

FOREIGN PATENT DOCUMENTS

| | | | |
|---|---|---|---|
| 1243988 | 11/1988 | Canada | 229/120.26 |

*Primary Examiner*—Gary E. Elkins

*Attorney, Agent, or Firm*—Whitham & Marhoefer

[57] ABSTRACT

The invention relates to a collapsible divider for insertion in a rectangular shipping box for dividing said shipping box into four compartments. A blank of foldable sheet material is zoned into rectangular sections by score lines and folded along the score lines to form a series of hingedly connected panels. The panels form two rectangles, being collapsible and biasing diagonally opposed edges, thereby urging the edges into transversal corners of a rectangular shipping box.

11 Claims, 3 Drawing Sheets

COLLAPSIBLE DIVIDER FOR A SHIPPING BOX

BACKGROUND OF THE INVENTION

1. Field of the Invention

The present invention generally relates to a collapsible divider for rectangular shipping boxes, and more particularly to an independent divider that forms four compartments and is selfstanding once erected in a box.

2. Description of the Prior Art

Independent, collapsible dividers that are erected and inserted in a shipping box to divide the box into compartments are well known in the prior art. A well known divider of this type is the so-called "H-divider", getting its name from the shape of the horizontal projection of the divider. The H-divider divides a rectangular shipping box in two compartments. U.S. Pat. No. 4,164,312 discloses an improved embodiment of an H-divider.

U.S. Pat. No. 4,376,507 discloses a partition structure formed from a one-piece blank of foldable sheet material for providing three cells of approximately equal length and width arranged in side-by-side relation within an outer wrapper or shipping container.

U.S. Pat. No. 4,335,842 discloses a partition member also defining three compartments in a rectangular shipping case. This member is made from a unitary blank of foldable sheet material.

U.S. Pat. No. 4,379,518 discloses a three cell divider for a rectangular box, formed from a unitary blank of foldable sheet material.

A four cell divider, well known in the art, consists of two blanks of corrugated paperboard or similar material, each having a slot situated on its symmetry axis, extending for approximately half the depth of the blank. The width of the slots approximately match the thickness of the blank for easy assembly. A disadvantage of this cell divider is that it tends to collapse once erected and inserted in a box, hindering proper loading of the box.

To overcome these shortcomings different propositions have been made. U.S. Pat. No. 4,071,185 to Peters discloses a structure for locking partitions in open position.

U.S. Pat. No. 4,492,332 to Collins discloses a carton divider with a tab flexibly attached to the inner end of a slot extending in one of the blanks forming the partition and a laterally arcing inner portion at the end of the other partition slot.

SUMMARY OF THE INVENTION

It is an object of this invention to provide a four-cell divider for insertion into a rectangular shipping box; a divider that can be shipped in a preassembled, collapsed state and nevertheless keeps form once it is deployed and inserted into a shipping box.

It is a further object of the invention to provide a divider with the above-mentioned features that is furthermore capable to add to the vertical rigidity of the shipping box within which it is inserted.

Briefly, this invention contemplates the provision of a divider which is formed from a unitary, elongated, rectangular sheet of a foldable sheet material, such as corrugated paperboard. The sheet is zoned into rectangular sections by score lines which are situated transversely to the longer edges of the sheet. At the score lines the sheet is folded so that the sections form a series of connected panels, which are hingedly connected to each other. The sheet comprises at least seven sections, and preferably nine sections. Three large sections are connected to a central section on each side of the central section to form, on each side of the central section, a rectangle. In the preferred embodiment, a small section is located at each end of the sheet and is glued or otherwise secured to the central section.

Foldable sheet material of a certain thickness has a tendency to straighten, if it is folded or angled along a score line. If, for example, a sheet of corrugated paperboard is angled along a score line to form a right angle, it will tend to straighten. This tendency biases the outermost edges of the divider against diagonally opposed corners of the box within which it is inserted.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
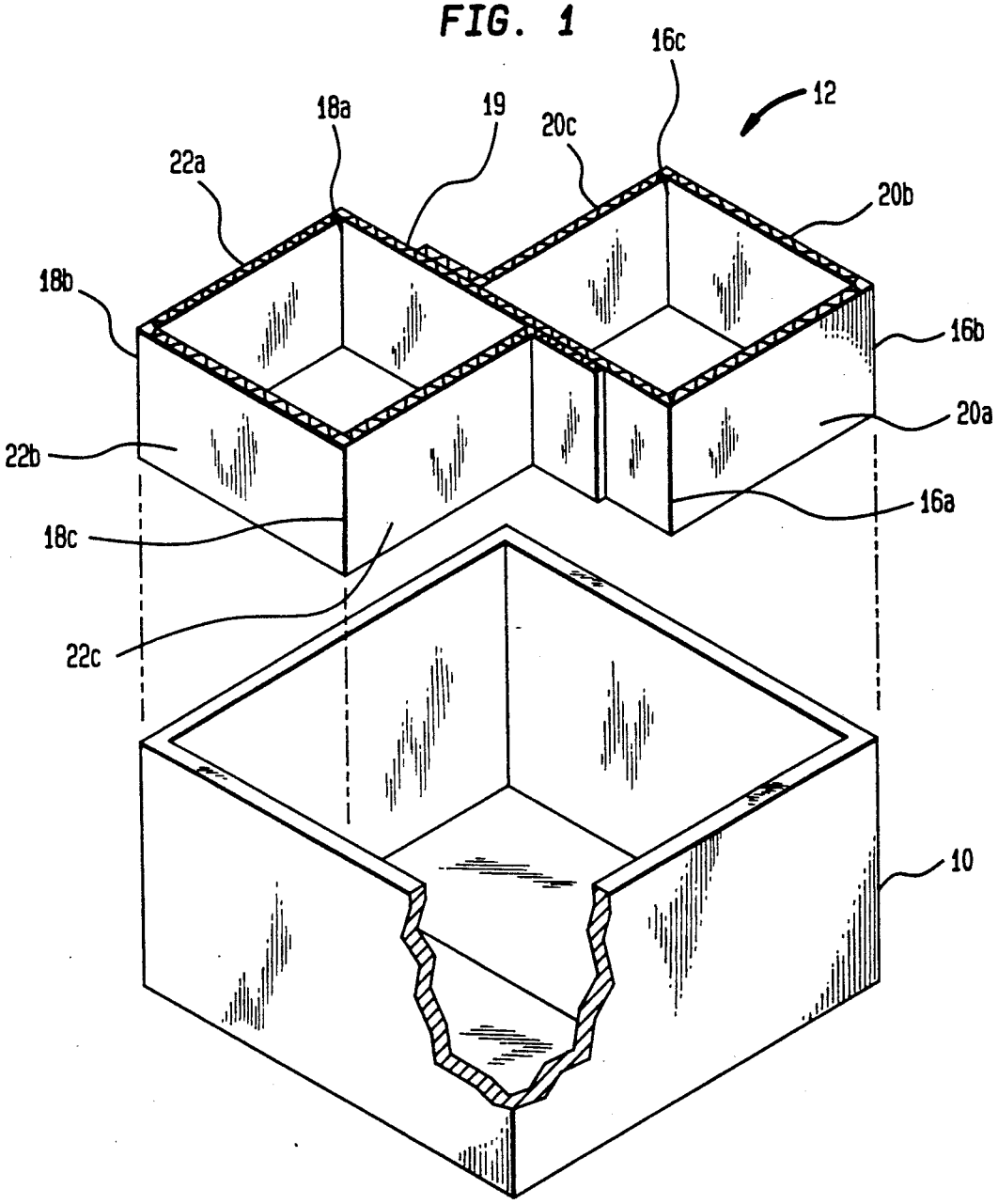
FIG. 1 is an exploded perspective view of an embodiment of the inventive divider and a shipping box within which it is inserted.

Referring now to the drawings, and more particularly to FIG. 1, there is shown a shipping box 10 with a square cross-section. The volume of the shipping box is divided into four compartments of equal size by an inserted divider indicated by the reference numeral 12. It will be appreciated that the invention is applicable to boxes that are of any rectangular shape, and the compartments need not be equal.

Figure 3:
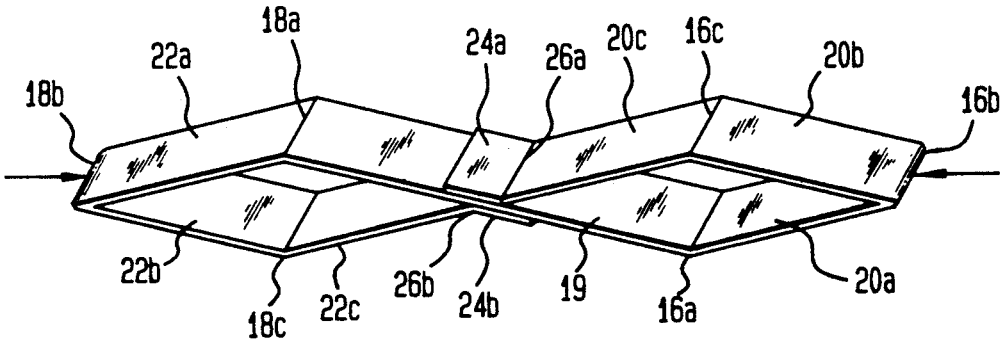
FIG. 3 is an perspective view of the divider of FIG. 2 in halfway erected state.
Figure 4:
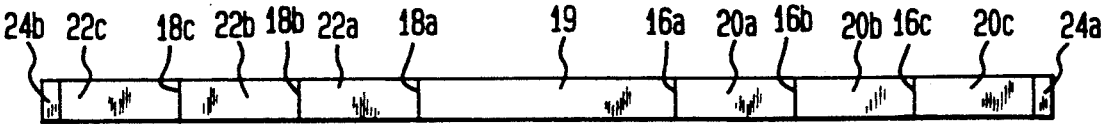
FIG. 4 is a schematic view of a sheet with score lines to form the divider of the foregoing figures.

The divider consists of a sheet of corrugated paperboard 14 or other suitable material, as can be seen in FIG. 4, which is folded at score lines 16*a*, 16*b*, 16*c* and 18*a*, 18*b*, 18*c*. Folded edges in FIG. 1 and 3 are indicated by the same reference numerals as the referring score lines in FIGS. 2 and 4. The score lines zone the sheet into rectangular sections 19, 20*a*, 20*b*, 20*c* and 22*a*, 22*b*, 22*c*. The sections are hingedly connected to each other.

In this embodiment the central section 19 is about twice the breadth of the other sections. The sheet is folded at the three score lines 16*a*, 16*b* and 16*c* on the right half of the sheet towards the front surface of the sheet, and is folded at the three score lines 18*a*, 18*b* and 18*c* on the left half towards the back surface of the sheet.

Adjacent to the outermost sections 20*c* and 22*c* are two further short sections, forming two flaps 24*a* and 24*b*. The end portions are angled at score lines 26*a* and 26*b* to form these flaps.

The sections 16*a*, 16*b* and 16*c*, and one-half of the central section 19, form a rectangle which is connected to a second rectangle formed by the other half of the central section 19 and the three remaining sections 18*a*, 18*b* and 18*c*. The flaps 24*a* and 24*b* at the end of the blank adjacent the outermost panels 16*c* and 18*c* contact the middle panel on one of its surfaces each and are fixed by glue, thereby fixing the adjacent outermost panels.

The two rectangles are aligned center symmetrical with respect to each other at one corner due to the rigid central section forming part of both rectangles. The sections extending to the left and to the right of middle section 19, are folded in counterclockwise direction at the score lines as can be seen in FIG. 2 or FIG. 3.

Figure 2:
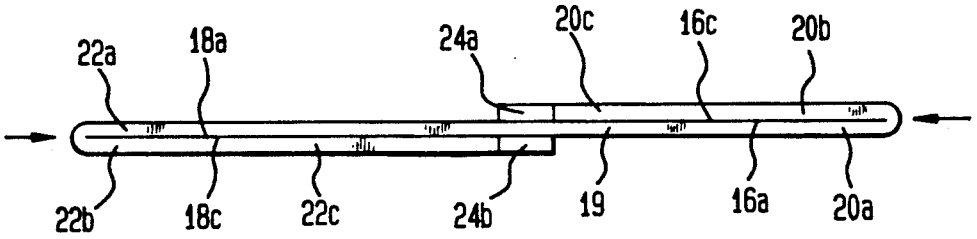
FIG. 2 is a view of the divider in completely collapsed state.

By squeezing together opposite edges 16*a*, 16*c* and 18*a*, 18*c*, respectively, the divider can be flattened as shown in FIG. 2. The cross-section of the rectangle will then be deformed to a flat rhombic quadrangle, the angle between sections 20*a* and 20*b* as well as the angle between sections 22*b* and 22*c* getting sharper the more said opposite edges are squeezed together.

In fully collapsed state of the divider, sections 22*a* and 22*b* are abutting as well as edges 18*a* and 18*c*, sections 22*c* and left half of section 19, section 20*c* and right half of section 19, edges 16*c* and 16*a* and sections 20*b* and 20*a*, respectively, as can best be seen in FIG. 2.

In fully collapsed state the divider can be stacked to form a pile with other dividers, can be bundled and the manufacturer of the divider can deliver the divider.

The user of the divider wishing to insert it into a shipping box simply has to push onto diagonally opposed located edges 16*b* and 18*b* thereby erecting the divider to form two rhombes as can best be seen by comparing FIG. 3 and FIG. 2 and as is described herein.

By further pushing onto the edges 16*b* and 18*b*, as indicated by arrows in FIG. 3, the rhombic or diamond-like cross-sections transform into square while the divider exerts a counterforce biasing said edges and urging them into diagonally opposed corners of the shipping box, once the divider is inserted into the latter.

To simplify insertion of the divider into the box, the divider can be squeezed even more than necessary to reach the position in which the sections form right angles in between them. The cross-sections are then rhombic with the longer diagonal extending between the edges 18*a* and 18*c*, and 16*c* and 16*a*, respectively. After insertion the biasing force of the divider will reestablish the rectangles by urging edges 16*b* and 18*b* into the corners of the shipping box, as shown in FIG. 1.

Figure 5:
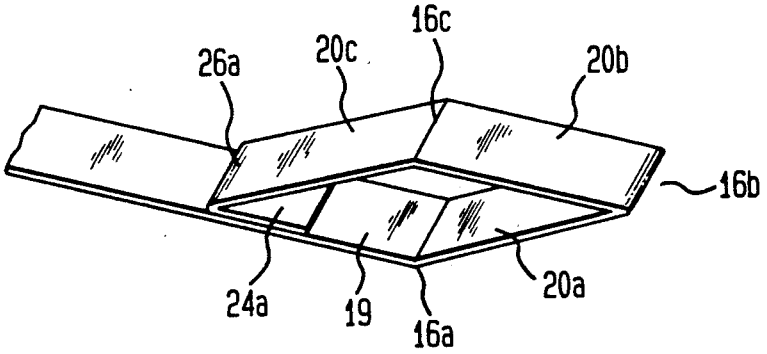
FIG. 5 is a partial view of a modified embodiment of the divider of FIG. 3.

FIG. 5 shows a different way of folding the sheet at score lines 26*a* and 26*b* to form flaps 24*a* and 24*b*.

Figure 6:
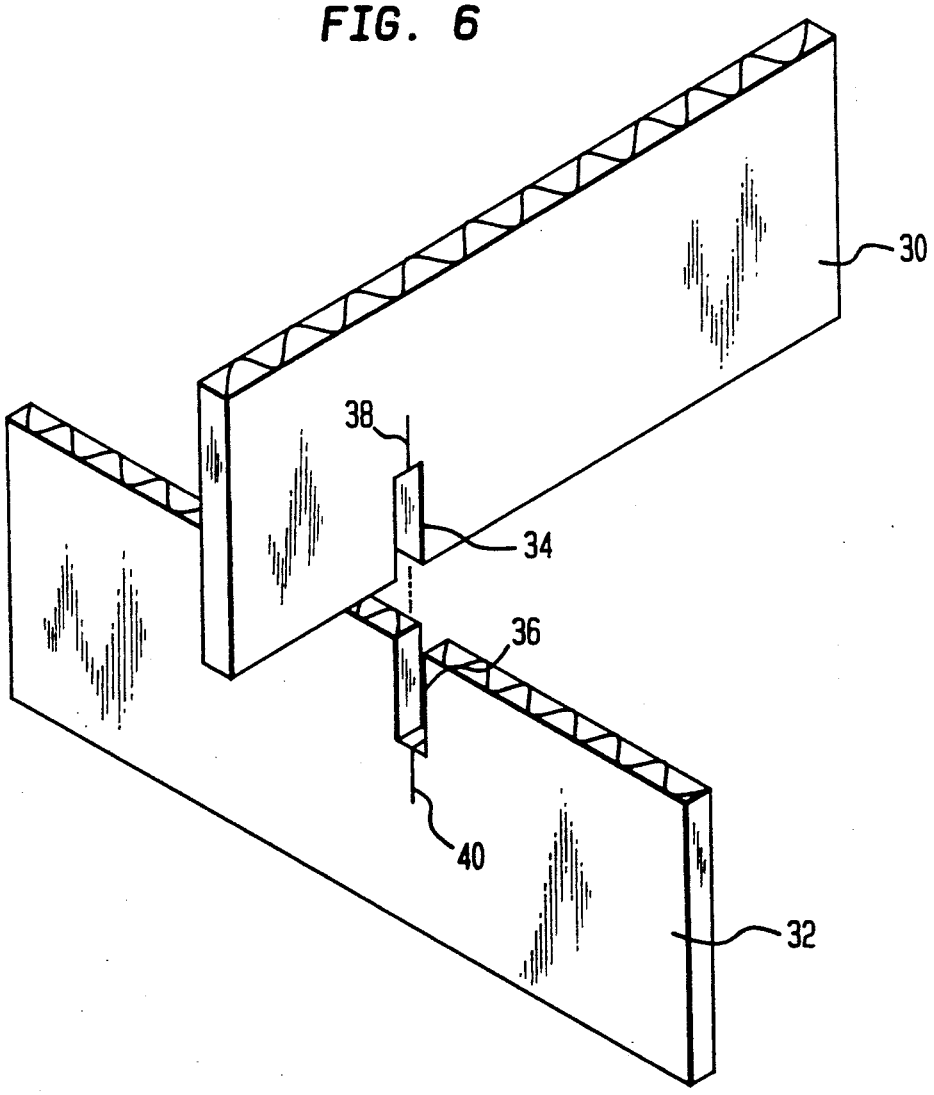
FIG. 6 is a perspective view of a different inventive divider.

FIG. 6 shows a different inventive divider for a shipping box that can be stored in a flat position. The divider comprises two blanks 30, 32 of rectangular sheet material, like corrugated paper board, each of them having a slot 34, 36 extending in the shorter symmetric axis. The slots 34, 36 have a breadth that equals the thickness of the sheet material of which the blanks are made, to facilitate putting together the two blanks. While the slots of known dividers made of two rectangular blanks extend over half the height of the blank, the slots 34, 36 of the inventive divider are shorter. The slots 34, 36 are continued according to the invention by so called knife-cuts 38 and 40, forming slots which are of more narrow breadth compared to the thickness of the sheet material. Once the two blanks are inserted mutual in the referring slots, the knife-cuts stiffen the divider in order to prevent it from collapsing.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A collapsible divider for insertion in a rectangular box that has a first set of opposed parallel walls of a first length and a second set of opposed parallel walls of a second length, said divider comprising:

a unitary, elongated, rectangular sheet of a foldable material having a front surface and a back surface; a long dimension with long edges and a short dimension with short edges, as well as a right half and a left half, at least six score lines situated transversely to the long dimension of said sheet, three of said score lines situated in said left half and three in said right half, said score lines forming seven sections, a central one of said sections being substantially equal in length to said first length, a first pair of said sections connected along a first pair of said score lines to said central section on either side of said central section, each of the two sections forming said first pair being substantially equal in length to one half of said second length; a second pair of sections connected along a second pair of said score lines respectively to each of said first sections; a third pair of said sections connected along a third pair of score lines respectively to each of said second sections, each of said sections forming said third pair being substantially equal in length to one half of said second length;

said sheet being folded at the three score lines situated in the right half towards the front surface and at the three score liens situated in the left half towards the back surface, so said first, second and third sections form a rectangle on the front surface and the back surface, respectively; and means to secure the smaller edges of the sheet to said central section in a way that said first sections and said third sections are parallel to each other to form a collapsible divider that when erected in a box divides the box into four compartments.

2. The divider of claim 1, wherein said second sections have the same length.

3. The divider of claim 2, wherein said second sections substantially equal in length to one half of said first length.

4. A collapsible divider for insertion in a rectangular box that has a first set of opposed parallel walls of a first length and a second set of opposed parallel walls of a second length, said divider comprising:

a unitary, elongated, rectangular sheet of a foldable material having a front surface and a back surface; a long dimension with long edges and a short dimension with short edges, as well as a right half and a left half, at least eight score lines situated transversely to the long dimension of said sheet, four of said score lines situated in said left half and four in said right half, said score lines forming seven sections, a central one of said sections being substantially equal in length to said first length, a first pair of said sections connected along a first pair of said score lines to said central section on either side of said central section, each of the two sections forming said first pair being substantially equal in length to one half of said second length; a second pair of sections connected along a second pair of said score lines respectively to each of said first sections; a third pair of said sections connected along a third pair of score lines respectively to each of said second sections, each of said sections forming said third pair being substantially equal in length to one half of said second length; and a fourth pair of relatively short sections of said sections connected along a fourth pair of said score lines respectively to each of said third sections;

said sheet being folded at the three score lines situated in the right half towards the front surface and at the three score liens situated in the left half towards the back surface, so said first, second and third sections form a rectangle on the front surface and the back surface, respectively;

said fourth sections being folded at the score lines forming said fourth pair of score lines; and means to secure said fourth sections to said central section in a way that said first sections and said third sections are parallel to each other to form a collapsible divider that when erected in a box divides the box into four compartments.

5. The divider of claim 4, wherein said fourth sections are folded at the score lines forming said fourth pair of score lines in opposite direction than the score lines forming said third pair of score lines.

6. The divider of claim 4, wherein said fourth sections are folded at the score lines forming said fourth pair of score lines in the same direction than the score lines forming said third pair of score lines.

7. The divider of claim 4, wherein said second sections have the same length.

8. The divider of claim 4, wherein said second sections substantially equal in length to one half of said first length.

9. The divider of claim 7, wherein said second sections substantially equal in length to one half of said first length.

10. The divider of claim 5, wherein said fourth sections are glued to said central section.

11. The divider of claim 4, wherein said fourth sections are glued to said central section.

* * * * *